United States Patent [19]

Hajek et al.

[11] Patent Number: 4,821,640

[45] Date of Patent: Apr. 18, 1989

[54] PRINTING MACHINE REGISTER ADJUSTMENT SYSTEM

[75] Inventors: Josef Hajek, Friedberg; Hans Mamberer, Königsbrunn, both of Fed. Rep. of Germany

[73] Assignee: M.A.N. Roland Druckmaschinen AG, Offenbach am Main, Fed. Rep. of Germany

[21] Appl. No.: 181,310

[22] Filed: Apr. 13, 1988

[30] Foreign Application Priority Data

Apr. 14, 1987 [DE] Fed. Rep. of Germany ..... 3712702

[51] Int. Cl.[4] ..... B41F 5/18; B41F 5/22

[52] U.S. Cl. ..... 101/177; 101/180; 101/220; 101/248

[58] Field of Search ..... 101/177, 179, 180, 176, 101/220, 221, 248, 181, 137, 142, 143, 217

[56] References Cited

U.S. PATENT DOCUMENTS 4,222,325 9/1980 Edwards ..... 101/177

4,394,835 7/1983 Gertsch et al. ..... 101/177

4,572,074 2/1986 Guaraldi ..... 101/181 X 4,635,546 1/1987 Grossman et al. ..... 101/248

4,638,734 1/1987 Grossman et al. ..... 101/248

4,753,168 6/1988 Theilacker ..... 101/220

*Primary Examiner*—J. Reed Fisher

*Attorney, Agent, or Firm*—Frishauf, Holtz, Goodman & Woodward

[57] ABSTRACT

To permit both circumferential as well as axial register adjustment of three printing couples (1, 2, 3), in which the respective cylinders of the printing couples are interconnected by spiral gears, two of the blanket cylinders (4, 8) are axially shiftable. The changes in circumferential register, upon changing of lateral register—due to the spiral gears—are compensated by position motor controllers (34, 44) which may include a microprocessor (50), automatically. Lateral register is set in a predetermined sequence by the respective cylinders, in accordance with the coupling of one of the plate cylinders (e.g. 5) with a printing machine main drive pinion (68).

19 Claims, 4 Drawing Sheets

PRINTING MACHINE REGISTER ADJUSTMENT SYSTEM

The present invention relates to a register adjustment system for use in printing machines having three printing couples which, for example, are located in a general Y configuration, and which have inclined or spirally toothed drive gears.

BACKGROUND

Printing machines with printing couples which include a plate cylinder and a blanket, typically rubber blanket cylinder, and in which the printing couples are generally in Y-shaped configuration, are known. The cylinders of the printing machines are driven via gears, coupled to shafts of the printing machines are driven via gears, coupled to shafts on the cylinders. The gears, when formed as inclined or spiral gears, provide for good meshing; upon axial shifting of any one of the cylinders, the spiral engagement of the gears will also cause rotation of the cylinders. The gears are in continuous meshing engagement, and all the cylinders are axially shiftable. Drive power to the cylinders of the three printing couples is obtained from a drive pinion, coupled to the main power drive of the machine. The drive pinion, likewise, has spiral teeth. It may be considered to define a fixed or reference circumferential rotary position since, upon axial shifting of an engaged cylinder, the engaged cylinder will also rotate with respect to the drive pinion.

It is known to change the register of printing machine cylinders by shifting the printing machine cylinders axially. Depending on the angle of inclination, axial shifting of any one of the cylinders will, necessarily, result in a rotary shift of the respective cylinders. Axial register adjustment, thus, may result in rotary misalignment. It is then necessary to compensate for the rotary shift if only axial register is to be changed. This, of course, is time-consuming and difficult to carry out. Clutches can be used interposed between the cylinders in the respective gear wheels, or the gears themselves may be shiftable or slidable on the shafts coupled to the cylinders, or stub shafts, integral therewith. This somewhat simplifies change of register and permits less time-consuming adjustment of register, but requires substantial structural equipment and, hence, is expensive.

THE INVENTION

It is an object to provide an inexpensive register adjustment provision for use with printing machine cylinders which are driven by inclined or spiral gears, and which permits rapid and reliable adjustment of lateral and circumferential register, and re-adjustment thereof, if necessary.

Briefly, axial position sensing means are operatively coupled to the three plate cylinders of the three printing couples. Two of the blanket cylinders of two of the printing couples are supplied with double gears and those blanket cylinders are coupled to axial position adjustment elements. The plate cylinders each are also coupled to plate cylinder positioning devices in order to axially shift the respective plate cylinders. Control apparatus is coupled to the shifting devices or apparatus units, typically electric motors, which effect axial positioning and adjustment of the respective ones of the two blanket cylinders upon axial shifting of at least one of the plate cylinders by one of the respective plate cylinder adjustment positioning devices or upon circumferential register change or adjustment of one of the plate cylinders. Drive power is transmitted by a drive pinion coupled to any one of the spiral gears and preferably to the spiral gear of one of the plate cylinders which forms a couple with one of the blanket cylinders which have the double gear attached thereto.

DRAWINGS, ILLUSTRATING AN EMBODIMENT OF THE INVENTION

DETAILED DESCRIPTION

Figure 1:
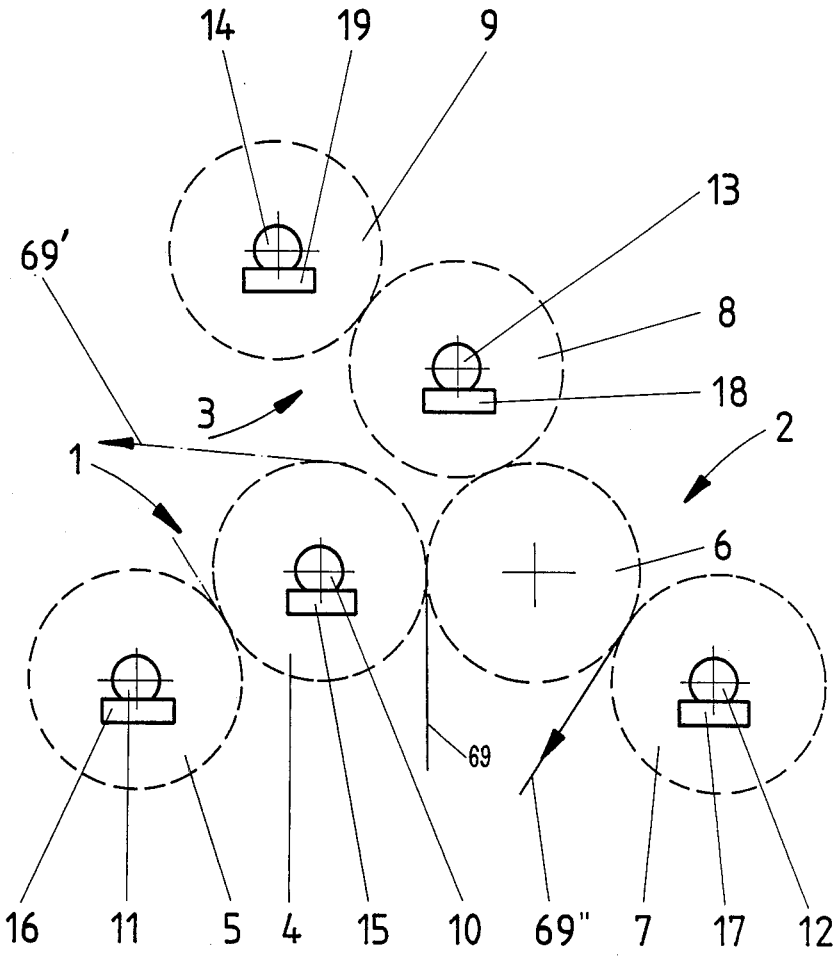
FIG. 1 is a highly schematic representation of a printing machine station having three printing couples and including the register adjustment system in accordance with the present invention.

The schematic representation of FIG. 1 illustrates a printing station which has three printing couples 1, 2, 3 located, essentially, in inverted Y configuration. Each printing couple 1, 2, 3 has a respective rubber blanket cylinder 4, 6, 8 and a plate cylinder 5, 7, 9 associated therewith. The cylinders 5–9 have axial shaft stubs, located in side walls 20 (FIG. 2) of the printing machine. The stub shafts for cylinders 4, 5, 7, 8, 9 are shown at 10–14 in FIG. 2. Such a printing station can print on a substrate 69 by offset printing applying double prime printing impressions and one verso printing impression. Two such Y printing units can be located above each other, so that, then, on a web four different colors of prime printing and two colors on verso printing can be applied.

The basic arrangement will be described below; it is, however, within the scope of the invention and entirely possible to pass the web 69 in the path illustrated at 69' in FIG. 1 about one of the blanket cylinders, for example about the blanket cylinder 4, which then will form an impression cylinder, and applying a di-litho plate on the associated plate cylinder 1. Of course, a similar arrangement can be made with respect to the blanket cylinder 2, as shown by the path 69", in which case, then, plate cylinder 7 will have a di-litho plate applied. The term "di-litho" is used in this industry as a short-form designation for "direct lithographic printing", that is, printing directly from a lithographic printing plate, and is so used herein. In this manner, and utilizing the present invention for register arrangement, triple prime printing can be applied, that is, prime printing in three colors. The register adjustment and control, both for lateral as well as circumferential register, then is particularly advantageous, since register for each one of the respectively colored inks can be readily controlled and adjusted.

Figure 2:
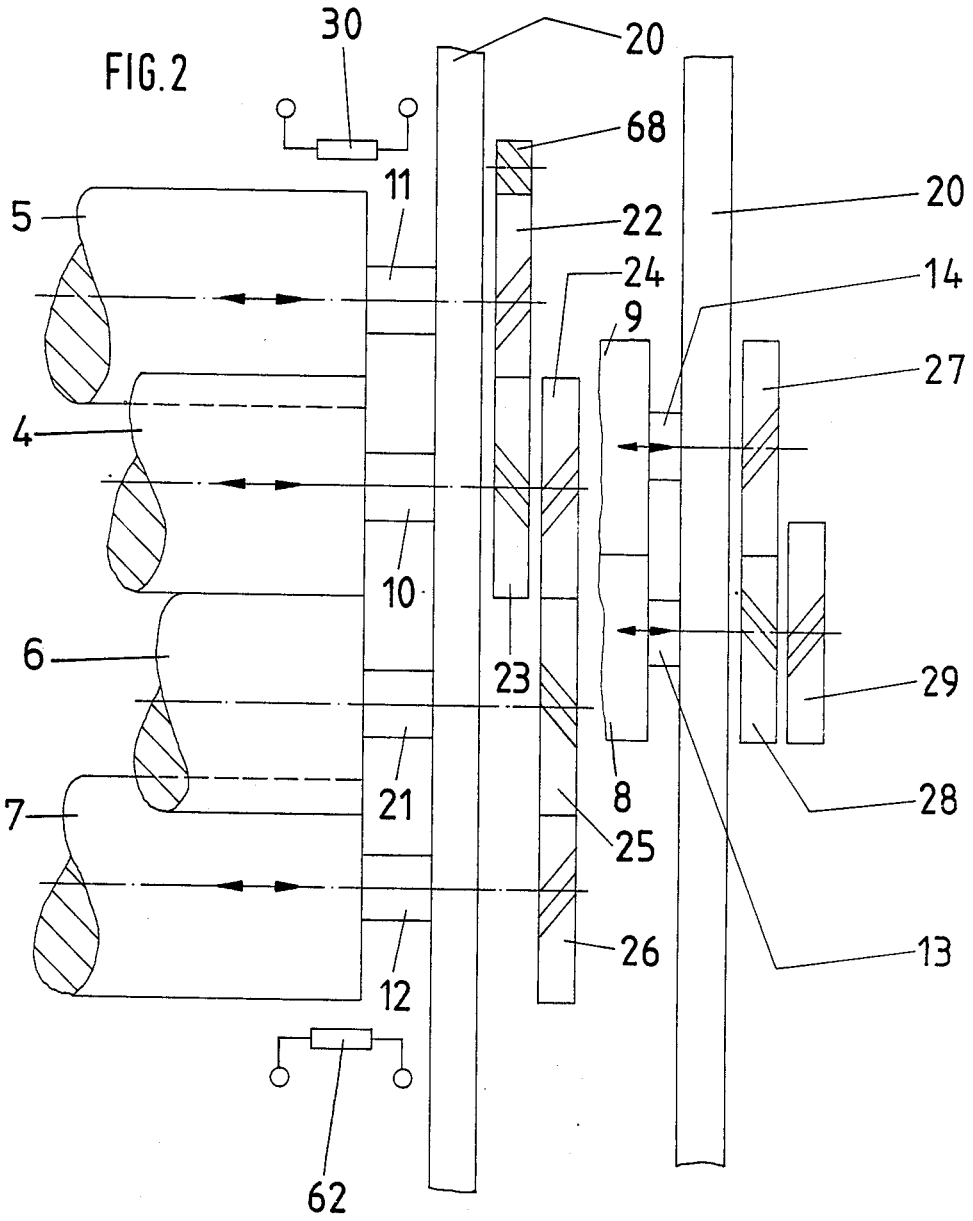
FIG. 2 is a schematic side view illustrating the inclined drive gearing for the printing couples of the register adjustment system.

As seen in FIG. 2, the cylinders 5-9 are driven by drive gears 22–29 which have inclined or spiral teeth. In the example illustrated, gear 22 on the shaft 11 of the plate cylinder 5 is additionally coupled to an inclined-geared pinion 68. The inclined-geared pinion 68 is coupled to the main drive of the printing machine. The blanket cylinder 4 has double-inclined-geared gear wheels 23, 24 located thereon, in which the angle of inclination of the respective gear wheels 23, 24 are opposite each other. Gear 23 is driven from gear 22 of the associated plate cylinder. The oppositely inclined gear 24 is coupled to the gear 25 on the blanket cylinder 6 on the stub shaft 21 thereof. Gear 26, on stub shaft 12 of the plate cylinder 7 of the second printing couple, is driven from the gear 25.

A further couple 3 with cylinders 8, 9 can be located, in accordance with a feature of the invention, above the printing couples 1 and 2. In FIG. 2, the drive is illustrated in a plane adjacent the plane of side wall 20 for clarity. In actual practice, of course, the side wall 20 will be in the single plane and gears 27, 28 will be in the plane of the gears 22, 23 and the gear 29 will be in the plane of the gears 24, 25, 26. The plate cylinder 9 of the third printing couple 3 is driven by the gear 27 on its stub shaft 14, which, in turn, is in engagement with gear 28 of the double gear 28-29 located on the stub shaft 13 of the associated blanket cylinder 8. The gear 29 is in driving engagement with the gear 25 of the blanket cylinder 6.

In accordance with a feature of the invention, the blanket cylinders 4 and 8 as well as the plate cylinders 5, 7 and 9 have a register adjustment arrangement coupled thereto which, preferably, is in form of positioning motors 15, 16, 17, 18, 19—see FIGS. 1 and 3, 4, 5. The cylinders 4–9 thus can be axially shifted by energization of the positioning motors 15–19. In accordance with a feature of the invention, one blanket cylinder, and in the present example the blanket cylinder 6, is not supplied with a register positioning motor and is axially fixed. In accordance with a preferred feature of the invention, the drive from the main drive shaft of the printing machine is applied by pinion 68 to the first printing couple 1. In other words, the drive pinion 68 is placed in engagement with the gear 22 of the plate cylinder 5. It is, of course, equally possible to introduce the main drive power, by a suitable drive gear, to the plate cylinder 7 or 9, or to the blanket cylinder 6. The general construction of the register adjustment arrangement will remain the same, but the adjustment sequences may have to be modified. It has been found that applying the drive power to the plate cylinder of the first printing couple is simple and preferred, and the invention will be described in connection with the drive applied by the gear 68 to the plate cylinder 5 of the first couple 1. The cylinders 4, 5, 7, 8 and 9, upon axial shifting, will not cause rotation of the plate cylinder 5 since the plate cylinder 5 cannot transmit rotary torque to the drive pinion 68. The drive pinion 68 is securely coupled to the main machine drive and determines or defines a rotary or circumferential reference position. Drive pinion 68 is not relatively rotatable with respect to the machine main drive shaft or the shaft on which it is secured.

In accordance with a feature of the invention, the register adjustment system includes axial position sensing elements which are coupled to the cylinders 4, 5, 7, 8 and 9, to provide electrical output signals representative of the lateral or axial position of the cylinders 4, 5, 7, 8 and 9 with respect to a reference, for example the side walls 20 of the machine. The position sensing elements may, for example, in their simplest form be linear potentiometers, of which potentiometer 30 is shown in FIG. 2, coupled to plate cylinder 5 of the printing couple 1. The plate cylinder 5, further, is coupled to the register positioning motor 16 as well as to the axial positioning sensing potentiometer 30. Similarly, blanket cylinder 4, and its positioning motor 15, has an axial position sensor 33 (FIG. 3) associated therewith. The position sensors of the respective cylinders other than cylinder 5 have been omitted from FIG. 2 for clarity and are shown only on the schematic diagrams of FIGS. 3–5. Plate cylinder 9 and its positioning motor 19 is associated with a sensor 40, and cylinders 7 and 8, as well as their motors 17 and 18, have position sensors 43, 62 coupled thereto. The blanket cylinder 6, which is axially fixed, does not have a register positioning motor associated therewith nor a positioning sensor. In accordance with the invention, only two of the three blanket cylinders, and in the example selected the blanket cylinders 4 and 8, are used to control and adjust circumferential register, as will be described in detail below. Switches 32, 42, 64 control the motors 16, 17, 19 (see FIGS. 3–5).

Two position motor controllers 34, 44 are provided which permit control of the positioning motors 15 and 18, respectively, by the controllers 34, 44. The position motor controllers 34, 44 are electrically coupled by suitable connection lines to the axial position sensors 30, 40, 62. The position motor controller 34 receives information in the form of an electrical signal from the sensor potentiometer 30, which is representative of the position of the positioning motor 16 as well as of the axial position of the plate cylinder 5. It also receives information from the axial sensor 33, coupled to blanket cylinder 4 regarding the axial position of the blanket cylinder 4 which, also, will correspond to the position of the positioning motor 35. The cylinders 4, 5 are coupled together mechanically by the gears 22, 23; likewise, cylinders 8 and 9 are coupled by gears 28 and 27 and cylinders 7 and 8 are coupled by gears 26 and 29 via gear 25. The positioning motors 16, 19, 17 are coupled by connections 65, 66, 67 (FIGS. 3, 4, 5) to the position sensors 33, 43, respectively. This interconnection means that, for example upon an axial shifting of plate cylinder 5, the plate cylinder 5 will also rotate and, since the drive pinion 68 will not rotate - that is, maintain its circumferential reference position, rotation of the plate cylinder 5 due to its axial shift will cause a change in the circumferential register due to rotation of the gear 22. Further, the axial position of the plate cylinder 5 will provide an indication on indicator 31 coupled to the positioning sensor 30. The axial position of the blanket cylinder 4 will appear on the position indicator 35 coupled to the sensor 33.

OPERATION, REGULATION AND ADJUSTMENT

Figure 3:
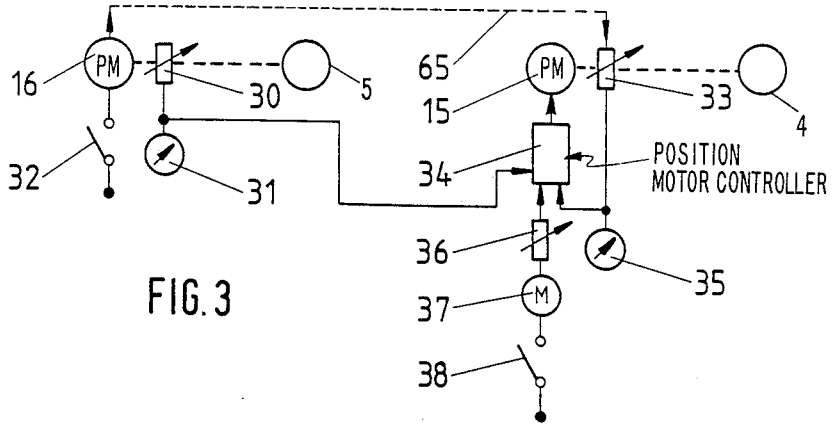
FIGS. 3, 4 and 5 are block diagrams of the control portion of the system.
Figure 4:
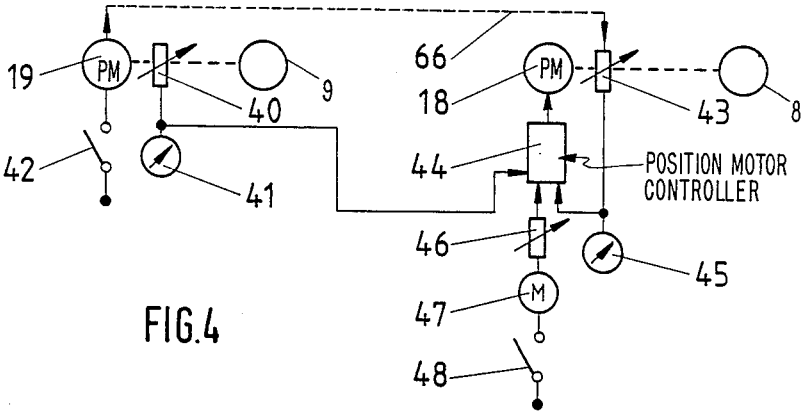

Adjustment of the circumferential register of the plate cylinder 5 is best seen with reference to FIG. 3. Adjustment of the circumferential register plate cylinder 9 is best seen in FIG. 4. Adjustment of the circumferential register of plate cylinder 7 is best seen with reference to FIG. 5.

Axial shift of plate cylinder 5 causes rotation thereof, as explained above, so that the circumferential register will likewise change. The axial position of the plate cylinder 5 can be read on indicator 31 and the axial position of the blanket cylinder 4 on the indicator 35.

The axial shift of the plate cylinder 5 is coupled to the position motor controller 34 via a connecting line from the sensor 30 to the controller 34. Controller 34 is so arranged that, then, it will initiate axial shift of the blanket cylinder 4 by rotating the positioning motor 15, thereby compensating for rotation of the plate cylinder 5. Thus, the lateral register positioning of the plate cylinder 5 is possible and, consequently, compensation of the resulting circumferential register is automatically compensated.

If the circumferential register of plate cylinder 5 is to be changed, switch 38 is closed and potentiometer 36 is controlled to operate the positioning motor 37 which, together with the potentiometer 36, forms a powered or controlled potentiometer to activate the position motor controller 34 in such a manner that the positioning motor 15 shift the blanket cylinder 4 axially. Axial shift of the blanket cylinder 4 also results in rotation of the blanket cylinder 4, which, due to the gear coupling, likewise rotates the cylinders 6, 7, 8 and 9. This means that, circumferentially, the plate cylinders 7, 9 are matched to the circumferential position, that is, are set on the circumferential register of the plate cylinder 5.

Figure 5:
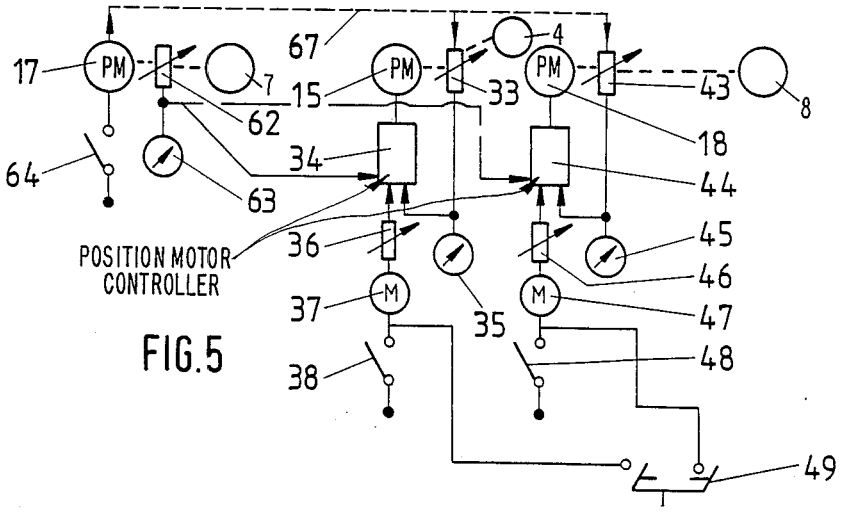

After the lateral register of the plate cylinder 5 is determined, the lateral register of the plate cylinder 7 can be set. In accordance with a feature of the invention, the lateral register or side register of the plate cylinder is obtained by axially shifting the plate cylinder 7 by the positioning motor 17 (FIG. 5). This axial shift results, however, also in rotation which can act only via cylinders 6 and 8 on the plate cylinder 9. Effectively, the circumferential position of the plate cylinder 5 is not changed anymore. If, as a third step, the lateral register of the plate cylinder 9 is adjusted by axial shifting thereof, the plate cylinder 9 will only rotate. This does not change, circumferentially, the plate cylinder 5.

By shifting the blanket cylinder 8, the influence of the plate cylinder 7 is compensated.

First the lateral register of the plate cylinder 9 is set, then the lateral register of the plate cylinder 7, and then the lateral register of the plate cylinder 9 is adjusted. Considering that, due to the fixed rotary position of the drive pinion 68, the plate cylinder 8 is maintained in a fixed circumferential position, the circumferential register adjustment or, respectively, subsequently necessary correction of the lateral register of the plate cylinders 5, 7, 9, are subjected to compensation, in accordance with a feature of the invention, by permitting axial shifting of the blanket cylinder 4 which permits circumferential shifting of the plate cylinders 7 and 9 to the circumference of the plate cylinder 5 for adjustment or re-adjustment.

If the circumferential register of the plate cylinder 9 is off, or out of alignment, compensation or matching can be obtained by shifting the blanket cylinder 8 axially. By shifting the blanket cylinder 8 axially, it will also rotate. This shift, however, cannot result in a rotation of the plate cylinder 5, nor in a rotation of the plate cylinder 7 due to the constraint imposed by the pinion 68.

If the circumferential register of the plate cylinder 7 is to be adjusted, it is necessary to shift the blanket cylinders 4 and 8 in axial direction. Due to the drive shown in FIG. 2, including the two double gears 23, 24 and 28, 29, respectively, rotation of the plate cylinder 7 due to axial shifting of the blanket cylinder 4 which, as known, cannot rotate the plate cylinder 5, will result - due to rotation consequent of axial shift - only in rotation on the plate cylinder 7. The plate cylinder 9 will not rotate, since the blanket cylinder 8 is shifted in the same axial direction as the blanket cylinder 4, so that the axial shift of the blanket cylinder 4 will not have an effect with respect to the circumferential register position of the plate cylinder 7 and will not feed back to the circumferential register of the plate cylinder 9.

In accordance with a feature of the invention, and as best illustrated in FIG. 4, the lateral position of the plate cylinder 9 is sensed by the position sensor 40, the value of which is indicated by indicator 41. The mechanical coupling, schematically shown as 66, provides a signal representative of the shift of the plate cylinder 9 or of the associated positioning motor 19, respectively, to the positioning sensor 40, which then will indicate the appropriate value on indicator 41, and further transmit the information to the positioning controller 44. The positioning controller 44 sets the circumferential register of the plate cylinder 9 and, by controlling the positioning motor 18, the blanket cylinder 8. The command value for the circumferential register of the plate cylinder 9 is controllable by controlling the potentiometer 46 after operation of the switch 48 and hence operation of the positioning motor 47 which permits setting a desired circumferential register value on the plate cylinder 9.

The circumferential register adjustment of the plate cylinder 7 is schematically shown in FIG. 5. It is necessary to energize both of the position motor controllers 34 and 44, as schematically indicated by switch 49 (FIG. 5). As described above, both the blanket cylinders 4 and 8 must be shifted axially.

As can be seen , it is sufficient to use only two positio motor controllers 34, 44 to set the circumferential register of the three plate cylinders 5, 7, 9 which are separately energized for circumferential register of the respective plate cylinders 5 and 9. They must be conjointly energized, however, if the circumferential register of plate cylinder 7 is to be adjusted, as shown in FIG. 5.

Figure 6:
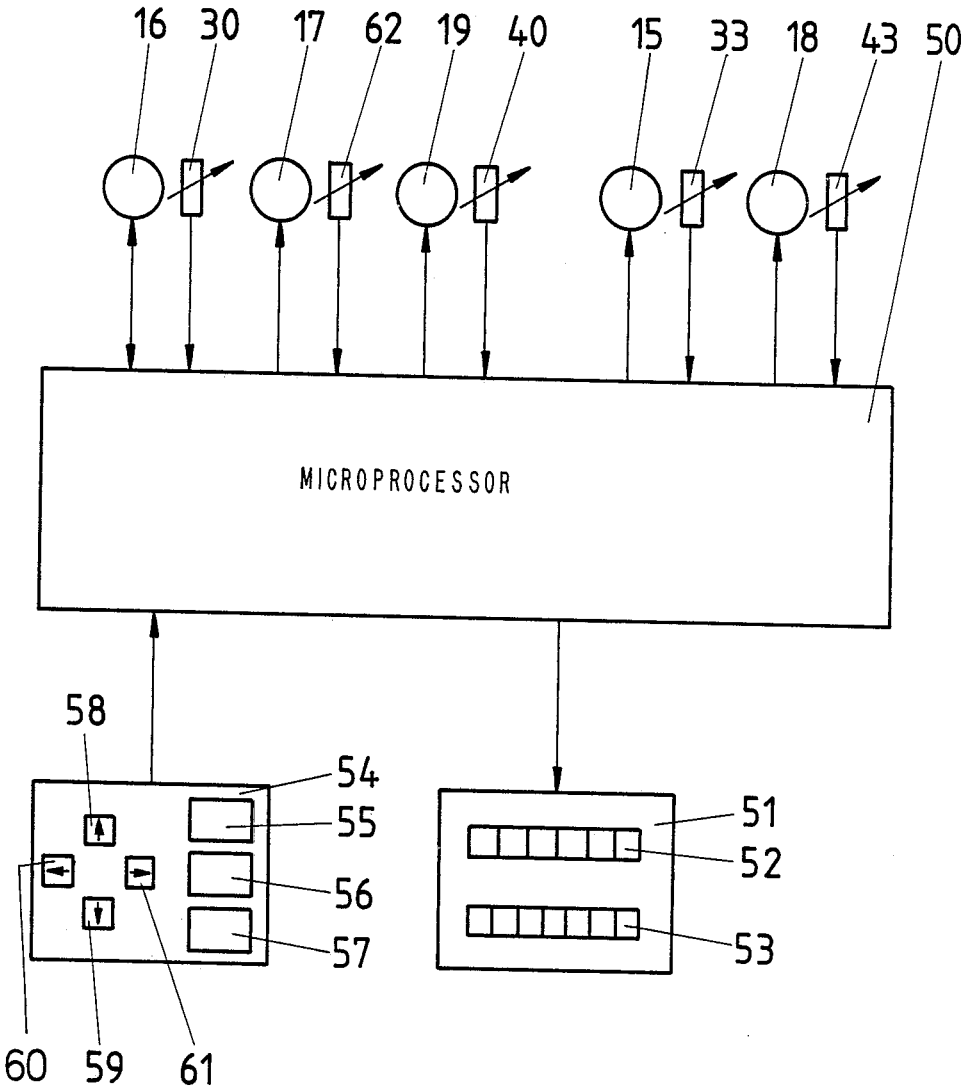
FIG. 6 is a schematic block diagram of another embodiment of the register adjustment system utilizing a microprocessor to carry out the adjustment functions.

FIGS. 3, 4 and 5 illustrate the way the circumferential registers can be adjusted and controlled by independently operating controllers, switches and the like. The entire sequence can be retained in a program in a microprocessor which, then, can provide for appropriate sequencing of the steps described above. FIG. 6 illustrates a microprocessor-equipped system which functionally is equivalent to the circuits of FIGS. 3 to 5. In accordance with a feature of the invention, the microprocessor-controlled arrangement of FIG. 6 is preferred. A commercial microprocessor 50 is used which has applied thereto the actual values of the axial positions of the five cylinders as signal thereto by the positioning sensors 30, 62, 40; 33, 43. The microprocessor 50 processes the signals representing the respective actual positions as well as command or register positions in accordance with the preceding description of the special and independent circuitry, and provides respective control signals to the register positioning motors 15, 16 (FIG. 3), 18, 19 (FIG. 4) and 17 (FIG. 5) as described above. Compensation of circumferential register, due to lateral shift or lateral register adjustment, is obtained by shifting blanket cylinder 4 for the plate cylinder 5, blanket cylinder 8 for the plate cylinder 9, and blanket cylinders 4 and 8 for the plate cylinder 7. The circumferential register control of cylinders 5, 7, 9 is obtained - as described - by shifting the circumferential register of the plate cylinder 5 by axially shifting the blanket cylinder 4; the circumferential register of plate cylinder 7 is shifted by shifting the blanket cylinder 4 together with the blanket cylinder 8; and the circumferential register of the plate cylinder 9 is shifted by shifting the blanket cylinder 8.

The circuit of FIG. 6 has an additional advantage: It is readily possible to obtain a display of the command values and actual values by displaying the information on a display panel 51, which has a command value display indicator 52 and an actual value display indicator 53. Further, an operating control panel 54 can be coupled to the microprocessor which has three control buttons or knobs 55, 56, 57 associated, each, with a color of ink to be printed. For example, if a first color of ink is to be adjusted both for lateral and circumferential register, it is only necessary to operate a single button or knob or key 55. The circumferential register of the respective plate cylinder is then controlled in forward and backward direction by means of the keys or buttons 58, 59 and the lateral register by keys 60, 61, for example in accordance with lateral right or left shift, respectively.

Various changes and modifications may be made within the scope of the inventive concept. For example, the pinion 68 need not be coupled to the gear 22, as shown; it is equally possible to couple the main drive power source to any one of the other plate cylinders 7 or 9. This will merely change the sequence of adjustment, which can be determined readily in accordance with the sequence above described with respect to maintaining the gear 22 fixed, and in a reference position. It is also possible to couple the main drive power to one of the blanket cylinders, for example the blanket cylinder 6 which is the one having only a single gear 25 coupled to its shaft 21. This is not a preferred coupling, however, since coupling a main drive pinion like the pinion 68 to a blanket cylinder may introduce difficulties if the blanket cylinders 4, 6, 8 are separated from each other upon stopping the machine so that, with respect to the mechanical drive location, engineering design problems may be encountered. Coupling the main drive power thus to plate cylinder is desirable; the embodiment illustrated in FIG. 2 has been found particularly suitable.

Various other changes and modifications may be made and any features described herein may be used with any of the others, within the scope of the inventive concept. A suitable microprocessor is Motorola 68000.

We claim:

1. Printing machine having three printing couples (1, 2, 3) for printing on a substrate (69), each printing couple having a blanket cylinder (4, 6, 8) and a plate cylinder (5, 7, 9), all of said printing cylinders being axially shiftable;

spiral gears (22–29) positioned on shafts of the respective cylinders for selected meshing engagement, said spiral gears including two double gears (23, 24; 28, 29) coupled respectively to two (4, 8) of the blanket cylinders, in which the individual gears of each double gear have oppositely directed spiral angles, and one (24, 29) of the individual gears of each of the double gears is in engagement with a spiral gear (25) coupled to the remaining blanket cylinder (6);

a drive pinion (68) coupled to one of said spiral gears, and comprising, in accordance with the invention, a printing machine register adjustment system including axial position sensing means (30, 40, 62; 33, 43) operatively associated with the three plate cylinders (5, 7, 9) and with those of the two blanket cylinders (4, 8) which are coupled to said double gears (23, 24; 28, 29);

blanket cylinder axial position adjustment means (15; 34; 18, 44; 50) coupled to the respective two blanket cylinders (4, 8) for effecting axial shifting thereof;

plate cylinder positioning means (16, 17, 19) coupled to the respective plate cylinders (5, 7, 9) for effecting axial shifting thereof, said blanket cylinder axial positioning means effecting axial positioning and adjustment of the respective ones of said two blanket cylinders (4, 8) upon at least one of:

(a) axial shifting of at least one of the plate cylinders (5, 7, 9) by a respective plate cylinder axial positioning means;

(b) circumferential register positioning or adjustment of one of said plate cylinders (5, 7, 9).

2. The machine of claim 1, wherein the blanket cylinder axial position adjustment means and the plate cylinder positioning means comprise respective positioning motors (15, 16, 17, 18, 19) axially shifting the shafts (10, 11, 12, 13, 14) of the respective cylinders.

3. The machine of claim 2, further including position indicators (31, 41, 63; 35, 45) coupled to the plate cylinders (5, 7, 9) and the respectively two blanket cylinders having the double gears for indicating the axial position of the respective cylinders with respect to a reference (20).

4. The machine of claim 1, wherein the blanket cylinder axial position adjustment means include position motor controllers (34, 44) and motor potentiometers (36, 37; 46, 47) coupled to the position motor controllers (34, 44), the motor potentiometers being controllable to record circumferential register command values for transmission as positioning information to said position motor controllers (34, 44).

5. The machine of claim 1, including means for setting the lateral register position of a first plate cylinder (5) of said printing couples by actuating the blanket cylinder axial position adjustment means (34) associated with the blanket cylinder (4) of the printing couple to which said first plate cylinder belongs.

6. The machine of claim 1, including means for setting the lateral register position of a third plate cylinder (9) of said printing couples by actuating the blanket cylinder axial position adjustment means (44) associated with the blanket cylinder (8) of the printing couple to which said third plate cylinder belongs.

7. The machine of claim 1, including means for setting the lateral register position of a second plate cylinder (7) of said printing couples by actuating the blanket cylinder axial position adjustment means (34, 44), which are both respectively associated with the blanket cylinders (4, 8) of the printing couples to which said plate cylinders belong.

8. The machine of claim 1, wherein said spiral gears (22–29) are located in two effectively parallel planes.

9. The machine of claim 1, wherein said blanket cylinder axial position adjustment means includes a microprocessor (50) to which said axial position sensing means (30, 40, 62; 33, 43) and said plate cylinder positioning means (16, 17, 19) are operatively coupled;

and wherein register positioning motors (15, 18) are provided, forming part of said blanket cylinder axial position adjustment means and controlled by said microprocessor.

10. The machine of claim 9, further including display means (51, 52, 53) coupled to said microprocessor and displaying command axial positions and actual axial positions of the respective cylinders.

11. The machine of claim 9, further including operating means (54) coupled to the microprocessor (50) including operator operable control elements (55, 56, 57) arranged, respectively, for controlling circumferential register and lateral register of the respective plate cylinders.

12. The machine of claim 11, further including display means (51, 52, 53) coupled to said microprocessor and displaying command axial positions and actual axial positions of the respective cylinders.

13. The machine of claim 9, wherein said blanket cylinder axial position adjustment means further includes a first positioning motor (15) and a second positioning motor (18), each positioning motor being coupled, respectively, to a first blanket cylinder (4) and a third blanket cylinder (8) of said blanket cylinders, for effecting axial shifting thereof;

and wherein said microprocessor (50) includes means for controlling said positioning motors and said plate cylinder positioning means (16, 17, 19) coupled to respective first, second and third plate cylinders (5, 7, 9) of said printing couples to place the first plate cylinder (5) in a reference position and then sequentially controlling axial shifting of the second plate cylinder (7);

said means further controlling the third positioning motor (19) coupled to the third plate cylinder (9) for axial shifting of the third plate cylinder (9);

said means controlling the first blanket positioning motor (15) for axial shifting of the first blanket cylinder (4) to determine the circumferential register of the first plate cylinder (5) with respect to the second plate cylinder (7); and said means controlling the blanket positioning motor (18) coupled to the third blanket cylinder (8) and forming part of said printing couple with the third plate cylinder (9) for axially shifting the third blanket cylinder (8) and setting the circumferential register of the third plate cylinder (9) with respect to the circumferential register of the first and second plate cylinders (5, 7).

14. The machine of claim 13, wherein the drive pinion (68) is coupled to the first one of said plate cylinders and determines the reference position thereof.

15. The machine of claim 13, wherein the printing couples are positioned in general Y configuration;

wherein the substrate (69) forms a web which is looped about one of the blanket cylinders (4 or 5) forming, in operation, an impression cylinder;

and wherein the plate cylinder (5 or 7) associated with said one blanket cylinder (4 or 6) comprises a direct lithographic printing plate cylinder.

16. The machine of claim 1, wherein the printing couples are positioned in general Y configuration;

wherein the substrate (69) forms a web which is looped about one of the blanket cylinders (4 or 6) forming, in operation, an impression cylinder;

and wherein the plate cylinder (5 or 7) associated with said one blanket cylinder (4 or 6) comprises a direct lithographic printing plate cylinder.

17. The machine of claim 1, including means for setting the lateral and circumferential register of said plate cylinders, said means actuating a first plate cylinder positioning means (16) associated with a first plate cylinder (5) for placing said first plate cylinder in a reference position;

said means actuating a second plate cylinder positioning means (17) associated with a second plate cylinder (7) and axially shifting said second plate cylinder;

said means actuating a third plate cylinder positioning means (19) associated with a third plate cylinder (9) for respective axial shifting thereof; and means for actuating a first blanket cylinder adjustment means (15) associated with a first blanket cylinder (4) and forming part of the printing couple with the first plate cylinder (5), for positioning said first blanket cylinder axially to determine the circumferential register of the second plate cylinder (7) with respect to the first plate cylinder (5);

and actuating a third blanket cylinder positioning means (18) for axially shifting a third blanket cylinder (8) forming part of the printing couple with the third plate cylinder (9) for shifting the circumferential register of the third plate cylinder (9) with respect to the circumferential register of said first plate cylinder (5) and said second plate cylinder (7).

18. The machine of claim 17, wherein the drive pinion (68) is coupled to the first one of said plate cylinders and determines the reference position thereof.

19. The machine of claim 17, wherein the printing couples are positioned in general Y configuration;

wherein the substrate (69) forms a web which is looped about one of the blanket cylinders (4 or 6) forming, in operation, an impression cylinder;

and wherein the plate cylinder (5 or 7) associated with said one blanket cylinder (4 or 6) comprises a direct lithographic printing plate cylinder.

* * * * *